US009206687B2

(12) United States Patent
Needham

(10) Patent No.: US 9,206,687 B2
(45) Date of Patent: Dec. 8, 2015

(54) MINING ROOF SUPPORT SYSTEM

(71) Applicant: Caterpillar Global Mining LLC, Oak Creek, WI (US)

(72) Inventor: Robert Needham, Pittsburgh, PA (US)

(73) Assignee: Caterpillar Global Mining America LLC, Houston, PA (US)

( * ) Notice: Subject to any disclaimer, the term of this patent is extended or adjusted under 35 U.S.C. 154(b) by 11 days.

(21) Appl. No.: 14/256,368

(22) Filed: Apr. 18, 2014

(65) Prior Publication Data

US 2015/0300169 A1 Oct. 22, 2015

(51) Int. Cl.
*E21D 17/00* (2006.01)

(52) U.S. Cl.
CPC ..... *E21D 17/00* (2013.01)

(58) Field of Classification Search
CPC ..... E21D 17/00
USPC ..... 405/288, 290, 291; 299/33; 175/219; 173/189
See application file for complete search history.

(56) References Cited

U.S. PATENT DOCUMENTS

| | | | | |
|---|---|---|---|---|
| 4,284,368 | A | 8/1981 | Albright | |
| 4,290,490 | A | 9/1981 | Barthe et al. | |
| 4,595,316 | A | 6/1986 | Tinnel | |
| 5,312,206 | A * | 5/1994 | Gaskins | 405/291 |
| 5,584,611 | A | 12/1996 | Clonch | |
| 5,938,376 | A | 8/1999 | Alcaraz | |

* cited by examiner

*Primary Examiner* — Sunil Singh

(57) ABSTRACT

A support system for a mining roof includes a base, a cylinder coupled to the base and configured to extend and retract, a pivot mechanism coupled to the cylinder, a roof support beam coupled to the pivot mechanism and configured to contact a surface of the mining roof, wherein the roof support beam and the pivot mechanism are raised relative to the base when the cylinder is extended and lowered relative to the base when the cylinder is retracted, and a support structure coupled to the base on a first end and coupled to the pivot mechanism on a second end, the support structure being configured to limit movement of the roof support beam about an axis provided by the cylinder.

14 Claims, 3 Drawing Sheets

MINING ROOF SUPPORT SYSTEM

TECHNICAL FIELD

This disclosure relates to underground mining vehicles, and particularly to a mining roof support system for underground mining vehicles.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Underground mining vehicles, such as roof bolters, may include roof supports (e.g., plates, pads, beams, etc.) for supporting the roof of an underground mine, such as to prevent the roof from collapsing. The roof supports may be adjustable in order to engage with the roof surface. For instance, the roof supports may be coupled to a vertical column or a scissor jack configured to move the roof supports vertically (i.e., raise or lower the roof supports) to engage the roof surface. However, as the roof supports are raised and lowered within the underground mine, the roof supports and the accompanying vertical column or scissor jack may become twisted (e.g., may rotate), which can cause damage to the components and perhaps cause the mining vehicle to malfunction.

Some mining vehicles may include a roof support mounted to a telescopic column and configured to raise and lower to engage a mining roof. An example of such a mining vehicle can be found in U.S. Pat. No. 4,282,368, issued Aug. 18, 1981, for "Vehicle with Dual Drill Booms and Temporary Roof Support," which discloses a mining vehicle wherein "a temporary roof support is removably mounted to end member at the forward end of the center boom tilt portion," and that "the temporary roof support has a telescopic column with a base portion." However, the disclosed mining vehicle with roof support does not include additional support to prevent the roof support and/or the telescopic column from twisting or rotating as the roof support is raised and/or lowered.

SUMMARY

An embodiment of the present disclosure relates to a support system for a mining roof. The support system includes a base, a cylinder coupled to the base and configured to extend and retract, a pivot mechanism coupled to the cylinder, a roof support beam coupled to the pivot mechanism and configured to contact a surface of the mining roof, wherein the roof support beam and the pivot mechanism are raised relative to the base when the cylinder is extended and lowered relative to the base when the cylinder is refracted, and a support structure coupled to the base on a first end and coupled to the pivot mechanism on a second end, the support structure being configured to limit movement of the roof support beam about an axis provided by the cylinder.

Another embodiment of the present disclosure relates to a roof bolter for underground mining. The roof bolter includes a body, a chassis coupled to the body, and a support system coupled to the chassis and configured to support a mining roof. The system includes a support base, a cylinder coupled to the support base and configured to extend and retract, a pivot mechanism coupled to the cylinder, a roof support beam coupled to the pivot mechanism and configured to contact a surface of the mining roof, wherein the roof support beam and the pivot mechanism are raised relative to the support base when the cylinder is extended and lowered relative to the support base when the cylinder is retracted, and a support structure coupled to the support base on a first end and coupled to the pivot mechanism on a second end, the support structure being configured to limit movement of the roof support beam about an axis provided by the cylinder.

Another embodiment of the present disclosure relates to a support system for a mining roof. The support system includes a base plate, a hydraulic cylinder coupled to the base plate and configured to extend and retract relative to the plate, a pivot mechanism coupled to the hydraulic cylinder, and a roof support beam coupled to the pivot mechanism and configured to contact a surface of the mining roof. The roof support beam is configured to pivot relative to the pivot mechanism to provide a vertical rotation of the roof support beam relative to the pivot mechanism. The roof support beam and the pivot mechanism are raised relative to the base plate when the hydraulic cylinder is extended and lowered relative to the base plate when the hydraulic cylinder is refracted. The system also includes a support structure coupled to the base plate on a first end and coupled to the pivot mechanism on a second end, the support structure being configured to limit a horizontal rotation of the roof support beam relative to the base plate.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
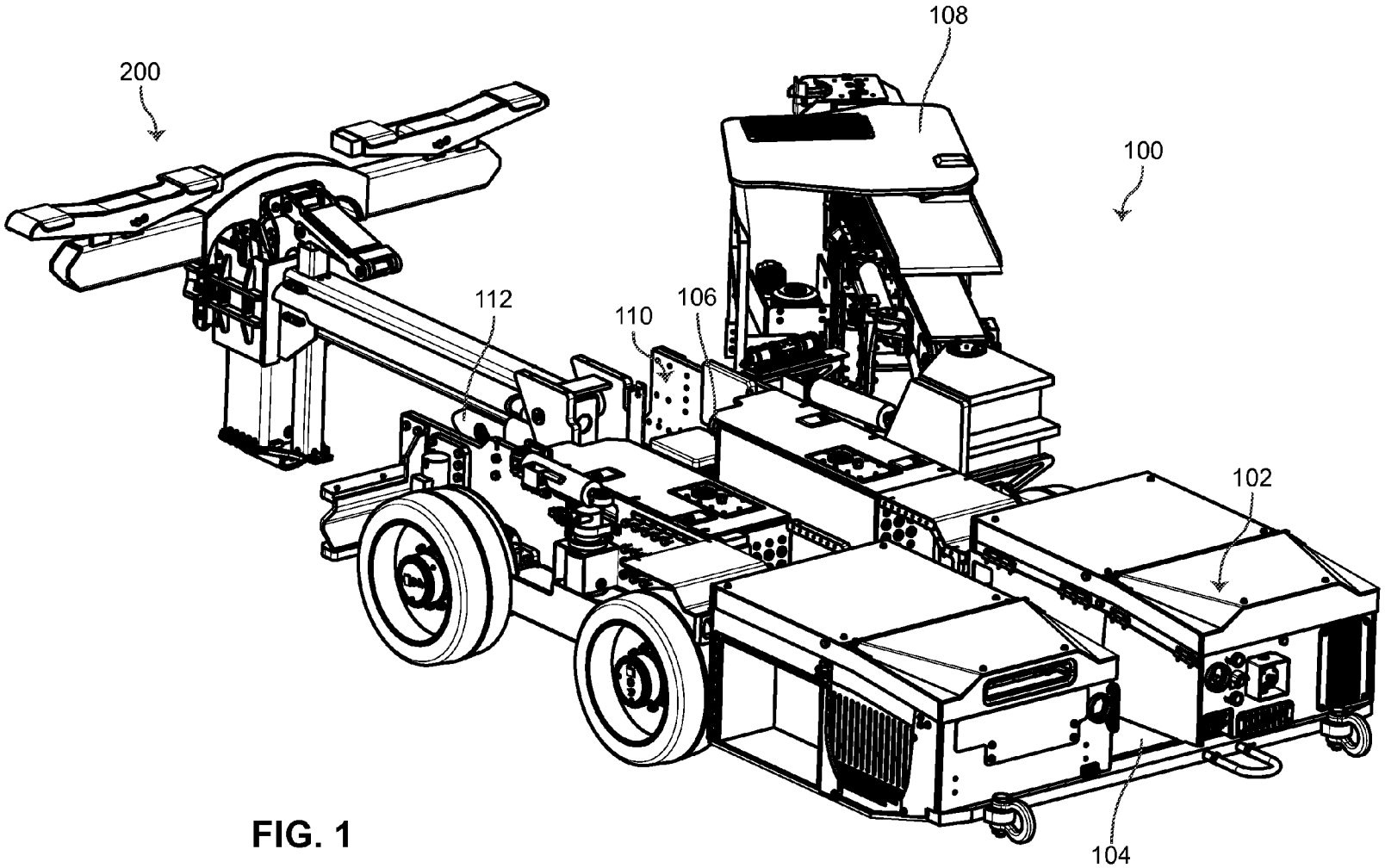
FIG. 1 is a perspective view of a roof bolter with a mining roof support system having a vertical lift column support, according to an exemplary embodiment.

Referring to FIG. 1, a roof bolter 100 is shown, according to an exemplary embodiment. The roof bolter 100 may be used to secure the roof of an underground mine or other space in order to prevent the roof of the mine from collapsing. The roof bolter 100 includes a body 102 for housing many of the functional components of the roof bolter 100. In this embodiment, the body 102 includes a platform 104 for an operator of the roof bolter 100 to stand, operator controls 106 for controlling one or more movements of the roof bolter 100, and a plate 108 for protecting the body 102 of the roof bolter 100 from debris. The roof bolter 100 also includes a chassis 110 (i.e., frame) coupled to the body 102. In the illustrated embodiment, the body 102 is mounted onto the chassis 110.

The chassis 110 provides a framework for the roof bolter 100, supporting the roof bolter 100 in its construction and use.

In an underground mining application, the roof bolter 100 includes a roof support system 200 that may be used to drill rock bolts (not shown) into the roof of a mine so that the roof is self-supportive and maintains its integrity. In an exemplary embodiment, the roof bolter may include an attachment component such as bracket 112 for coupling the roof support system 200 to the roof bolter 100. The attachment component may be coupled to one or both of the body 102 or the chassis 110. The roof support system 200 may be raised or lowered to accommodate the height of the mine roof, and may also be angled (e.g., similar to the motion of a teeter totter) in order to adjust to variations in the roof surface. The roof support system 200 is described in further detail below in reference to FIGS. 2 and 3.

Figure 2:
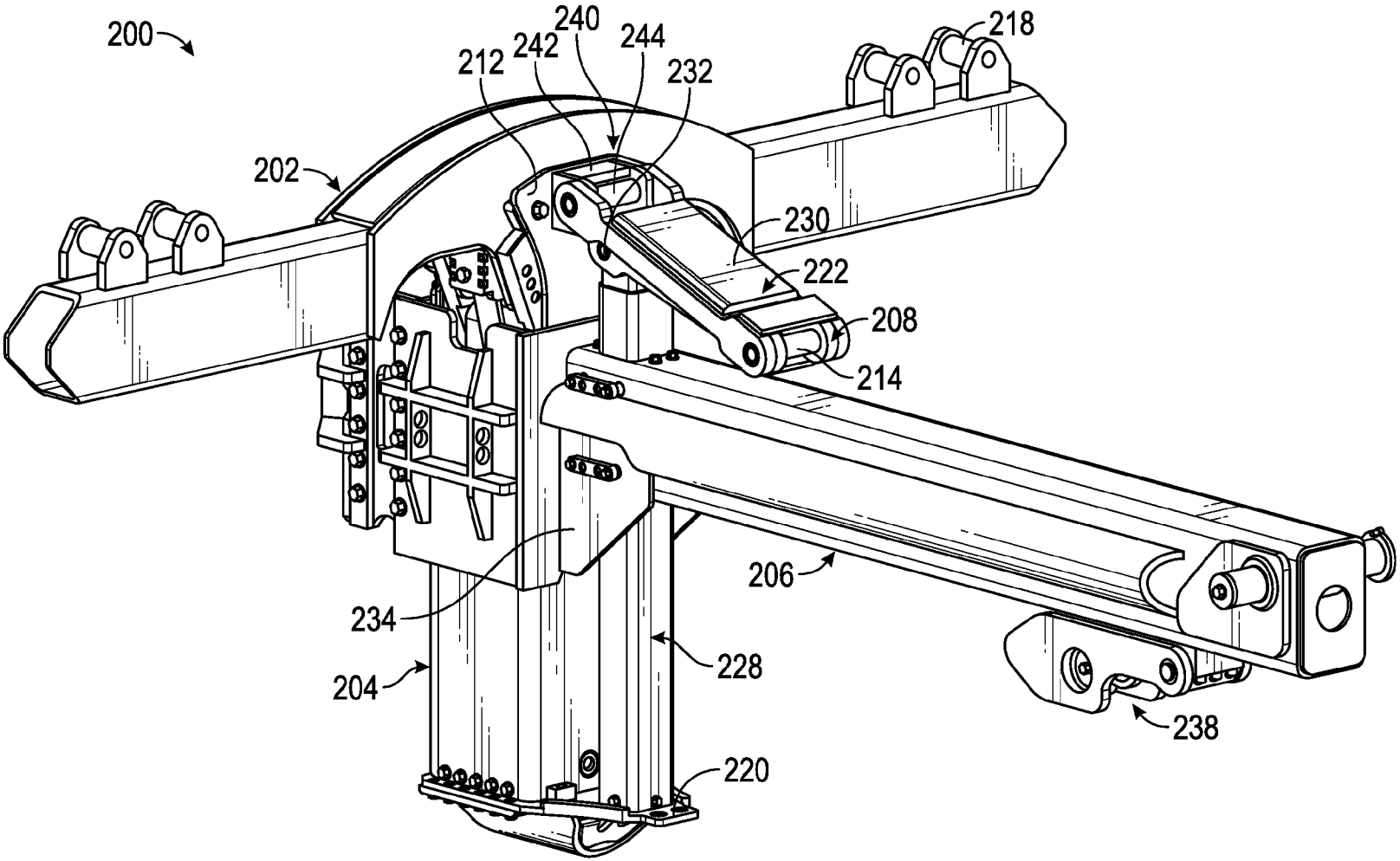
FIG. 2 is a perspective view of a mining roof support system in a lowered position, according to an exemplary embodiment.
Figure 3:
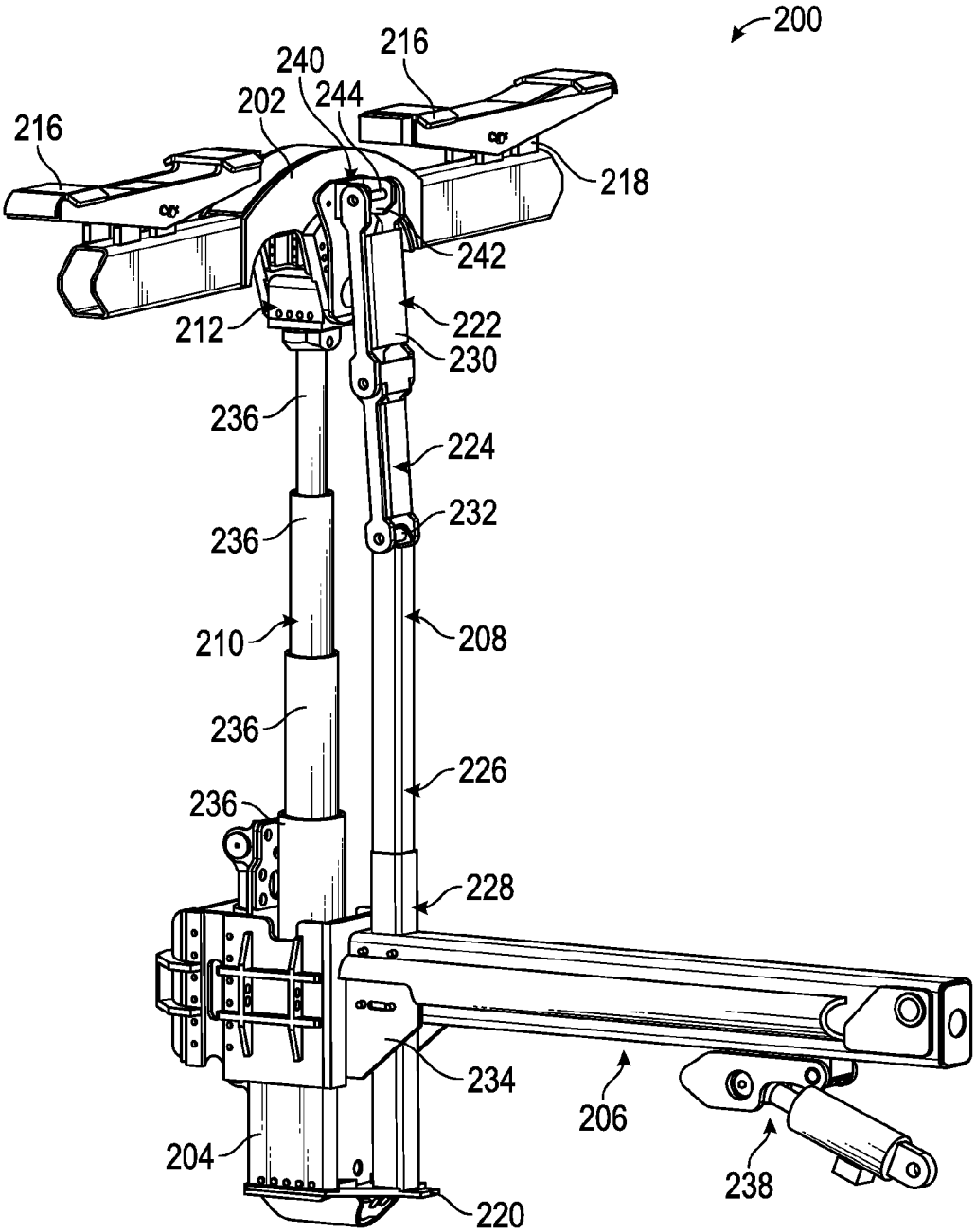
FIG. 3 is a perspective view of a mining roof support system in a raised position, according to an exemplary embodiment.

Referring now to FIGS. 2 and 3, the roof support system 200 is shown, according to an exemplary embodiment. The roof support system 200 is configured to provide support to the roof of an underground mine in order to prevent the mine from collapsing. In the illustrated embodiment of FIGS. 2 and 3, the roof support system 200 includes a substantially horizontal boom 206 configured to couple the roof support system 200 to the roof bolter 100. The boom 206 includes a bracket 238 which may be coupled to the bracket 112 or another component of the roof bolter 100 in order to couple the support system 200 to the roof bolter 100.

The roof support system 200 includes plates 216 (e.g., pads) which are coupled to a roof support beam shown as beam 202 (e.g., mast, rod, boom, etc.) that is configured to raise and lower to cause the plates 216 to contact the mine roof. In an exemplary embodiment, the plates 216 are made at least partially from a durable material configured to resist wear from contacting the mine roof. In one embodiment, at least portions of the plates 216 are removable and replaceable so that components that become worn may be replaced. In the illustrated embodiment, the plates 216 are each removably coupled to the beam 202 by a set of brackets 218 configured to receive the plates 216.

In an exemplary embodiment, the beam 202 is adjustable in more than one direction (i.e., plane of motion) to accommodate a range of roof heights and surface features. In the illustrated embodiment, the beam 202 is coupled to a multi-stage cylinder 210 positioned within a lift column 204. The cylinder 210 is configured to extend and retract in a telescopic manner in order to raise and lower the beam 202, respectively. The lift column 204 is a substantially hollow and tubular structure configured to house the cylinder 210. The lift column 204 may be sized and shaped according to one or more measurements of the cylinder 210. The lift column 204 is positioned vertically and coupled to a base plate 220 (e.g., base, platform, bracket, etc.) of the support system 200. A base portion of the cylinder 210 may also be coupled to the plate 220 and/or the lift column 204.

In FIG. 2, the cylinder 210 is shown in a fully retracted position in which the beam 202 and the plates 216 are lowered (i.e., in a lowered position). In this position, the cylinder 210 retracts to reside almost completely within the lift column 204. In FIG. 3, on the other hand, the cylinder 210 is shown in a fully extended position in which the beam 202 and the plates 216 are raised (i.e., in a raised position), such as to meet the surface of the mining roof. In an exemplary embodiment, the cylinder 210 may be extended or retracted to a plurality of positions between the fully retracted position of FIG. 2 and the fully extended position of FIG. 3. Likewise, the coupled beam 202 and plates 216 may be moved to a plurality of positions between the lowered position and the raised position when the cylinder 210 is extended or retracted.

In one embodiment, the cylinder 210 is configured to extend and retract in stages. Each successive stage may be enacted by a separate piston configured to apply an additional force to raise the beam 202. In FIG. 3, for example the cylinder 210 is shown to include a plurality of cylinder sections 236. In this embodiment, each section 236 may be extended from the base of the cylinder 210 by the firing of a piston within the cylinder 210 (or another applied force). In this way, the cylinder 210 may be extended in separate stages. In other embodiments, however, the cylinder 210 may be a single stage cylinder. In an exemplary embodiment, the cylinder 210 is operated by an operator of the roof bolter 100. In one embodiment, for instance, the cylinder 210 is operated hydraulically (e.g., controlled via hydraulic fluid) and the operator may control the cylinder 210 (and thus the height of the beam 202) using a hydraulic control system.

The beam 202 is coupled to the cylinder 210 via a pivot mechanism shown as pivot base 212. In the illustrated embodiment, the beam 202 is nested at least partially within the pivot base 212 and coupled to the pivot base 212. The beam 202 is configured to pivot or vertically rotate relative to the pivot base 212 (e.g., lean side to side, "teeter-totter," etc.) to achieve a substantially vertical partial rotation relative to the pivot base 212 (according to FIG. 2). As the beam 202 pivots within the pivot base 212, the plates 216 may be angled (e.g., raised or lowered relative to each other), such as to match a contour of the roof surface. For instance, if the mining roof is angled or includes an irregular feature, the beam 202 may be configured to pivot to a desired configuration within the pivot base 212 such that both plates 216 contact and support a surface of the mining roof. In other embodiments, the beam 202 and the pivot base 212 may be configured to pivot together and relative to the cylinder 210.

The beam 202 may be coupled to the pivot base 212 by one or more pins or fasteners (e.g., bolts). The beam 202 may be configured to pivot (e.g., rotate) relative to the fasteners and/or the pivot base 212 in order to achieve a necessary angle to meet the mining roof. In one embodiment, the beam 202 may be raised in a substantially level position (i.e., approximately perpendicular to the cylinder 210) and be configured to pivot or vertically rotate when one of the plates 216 is contacted by the mining roof. In this way, the beam 202 is automatically adjusted, or rotated, according to the contours of the mining roof and in order to support the roof. The articulation of the beam 202 (and the plates 216) may also be controlled by an operator of the roof bolter 100 via a hydraulic or pneumatic control system, in other embodiments.

The roof support system 200 also includes a support structure shown as anti-twist mechanism 208. The anti-twist mechanism 208 is configured to prevent the pivot base 212 and the beam 202 from twisting or rotating about the axis of the cylinder 210 (e.g., into or out from the page according to FIG. 3), such as when the beam 202 is raised or lowered. The anti-twist mechanism 208 is coupled to the pivot base 212 on a first end and coupled to the plate 220 on a second end. The anti-twist mechanism 208 enables the beam 202 (e.g., the pivot base 212) to remain coupled to the plate 220 even as the beam 202 is raised and lowered, which is intended to limit a twisting motion of the beam 202 relative to the plate 220 and the lift column 204.

In an exemplary embodiment, the anti-twist mechanism 208 includes a closed (e.g., folded, bent) configuration (shown in FIG. 2) and an open (e.g., unfolded, straightened) configuration. When the mechanism 208 is in the closed configuration, the cylinder 210 is in the fully retracted position and the pivot base 212 and the beam 202 are at least partially nested within the lift column 204, which may at least partially prevent the beam 202 from twisting or rotating in an unwanted direction (e.g., about the axis provided by the cylinder 210). However, when the mechanism 208 is moved to the open configuration, the beam 202 may otherwise be more susceptible to twisting or rotating relative to the cylinder axis. When the cylinder 210 is extended to raise the beam 202, the anti-twist mechanism moves from the closed configuration to the open configuration but remains coupled to the pivot base 212 and to the plate 220. The anti-twist mechanism 208 is configured to prevent movement of the beam 202 about the cylinder axis in either direction, which may prevent damage to the related components (e.g., the cylinder 210, the pivot base 212, the beam 202, etc.). The anti-twist mechanism 208 may also prevent unwanted axial rotation of the coupled cylinder 210.

In an exemplary embodiment, the anti-twist mechanism 208 includes more than one pivotable section such that the mechanism 208 is able to fold into the closed configuration when the cylinder 210 is retracted (as shown in FIG. 2). A first section 222 (e.g., a first pivotable section) is coupled to the pivot base 212 by a bracket assembly 240. When the anti-twist mechanism 208 is in the closed configuration, a plate 230 (e.g., pad, deflector, etc.) of the first section 222 forms a flat face or surface that may be positioned approximately parallel to the boom 206 and approximately perpendicular to the lift column 204. In other embodiments, the plate 230 (and the first section 222) may be angled downward from the bracket assembly 240 and toward the boom 206. The bracket assembly 240 includes a bracket 242 coupled to the pivot base 212 and a pin 244 that is sized to fit through slots of the first section 222 and the bracket 242 to couple the anti-twist mechanism 208 to the bracket 242. The first section 222 is configured to pivot about the axis of the pin 244 relative to the bracket assembly 240 (e.g., up and down), such as to allow the mechanism 208 to move between the open and closed configurations. The pin 244 may be coupled to the first section 222 and configured to rotate with the first section 222 relative to the bracket 242, or the pin 244 may be coupled to the bracket 242 such that the first section 222 is configured to rotate relative to both the bracket 242 and the pin 244.

The anti-twist mechanism 208 also includes a second section 224 (e.g., a second pivotable section) that is coupled to the first section 222 and configured to rotate relative to the first section 222. In the illustrated embodiment, the second section 224 is coupled to the first section 222 by a pin 214 and is configured to rotate relative to the first section 222 about the axis provided by the pin 214. The pin 214 may be similar to the pin 244. The pin 214 may be configured to rotate with or relative to the section 222 and/or the section 224. Likewise, the second section 224 may be configured to rotate with the pin 214 or relative to the pin 214. In the illustrated embodiment, the second section 224 is configured to pivot inward relative to the pin 214 in order to fit approximately within the first section 222 and be covered by the first section 222 when the roof support system 200 is in the lowered position of FIG. 2. In other embodiments, the sections of the anti-twist mechanism 208 (e.g., sections 222 and 224) may be configured to otherwise rotate or pivot relative to each other in order to reduce a footprint or occupied space of the anti-twist mechanism 208 when the mechanism 208 is moved to the closed configuration (e.g., when the beam 202 is lowered).

The anti-twist mechanism 208 also includes a third section 226 (e.g., a retractable section) coupled to the second section 224 by a pin 232. The pin 232 may be similar to the pin 214 and/or the pin 244. In the illustrated embodiment, the second section 224 is configured to rotate relative to the third section 226 around the axis provided by the pin 232. The pin 232 may be configured to rotate with and/or relative to the section 224. Similarly, the pin 232 may be configured to remain stationary within the third section 226 as the second section 224 is rotated or the pin 232 may rotate with the second section 224 relative to the third section 226.

The third section 226 is configured to fit within a base section 228 of the anti-twist mechanism 208 when the beam 202 is moved to the lowered position (i.e., the cylinder 210 is retracted). The base section 228 is substantially hollow and configured to at least partially store the third section 226 of the anti-twist mechanism 208 when the mechanism 208 is in the closed configuration. For instance, the base section 228 may be sized and/or shaped according to one or more measurements of the third section 226. As the beam 202 is raised and lowered, the third section 226 is configured to move out of and into the base section 228, respectively. The third section 226 is configured to remain in the same axis as the base section 228 when the beam 202 is raised or lowered. The third section 226 may include a stop or similar feature configured to prevent the third section 226 from separating completely from the base section 228 when the cylinder 210 is extended.

In one embodiment, the base section 228 is a separate piece (e.g., a removable component) from the boom 206. In an exemplary embodiment, the boom 206 is substantially stationary relative to the lift column 204. For instance, the boom 206 may be welded or otherwise permanently coupled to the lift column 204. In the illustrated embodiment of FIGS. 2 and 3, the base section 228 fits within an opening of the boom 206 that extends through the boom 206. The base section 228 may be coupled to the boom 206 by a bracket assembly 234 to limit movement of the base section 228 relative to the boom 206. In this embodiment, the base section 228 is also coupled to the plate 220. The opening of the boom 206 may be sized according to one or more measurements of the base section 228 in order to limit or prevent rotation of the base section 228 relative to the boom 206. In this way, rotation of the anti-twist mechanism 208, and thus the beam 202, may be limited relative to the boom 206. In another embodiment, the base section 228 and the boom 206 may be a unified or single component. In this embodiment, the coupled plate 220 may provide additional support (i.e., stabilization) for the boom 206 in preventing unwanted rotation or other movement of the beam 202.

When the beam 202 is raised (e.g., by extending the cylinder 210), the mechanism 208 is moved to the open configuration. In the open configuration, the mechanism 208 may be unfolded and extended such that the mechanism 208 is approximately parallel to the cylinder 210. Further, the sections 222, 224, and 226 of the mechanism 208 may be stacked on top of each other such that the mechanism 208 (i.e., the beam 202) reaches a maximum height. The sections 222, 224, and 226 may "lock," or remain static in response to a downward force applied by the beam 202 when the mechanism 208 is extended (as shown in FIG. 3). In another embodiment, the mechanism 208 may be controlled by a control system of the roof bolter 100 and moved between two or more configurations in response to operator commands or signals received from a controller of the roof bolter 100. In an exemplary embodiment, the anti-twist mechanism 208 moves relative to the cylinder 210 and the height of the mechanism 208 relative to the boom 206 at any time may be similar to the height of the cylinder 210. In other embodiments, the anti-twist mechanism 208 may include a greater or lesser number of sections, as is suitable for the particular application of the mechanism 208.

The construction and arrangement of the mining roof support system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

INDUSTRIAL APPLICABILITY

The disclosed mining roof support system may be implemented into underground mining vehicles, such as a roof bolter, in order to support a mining roof and prevent collapse of the mining roof. The mining roof support system includes an anti-twist mechanism that is intended to limit or prevent horizontal rotation of a support beam when the support beam is raised (e.g., to meet a surface of the mining roof) or lowered in order to prevent damage to the support beam or any related components of the support system. The anti-twist mechanism includes pivotable sections and is intended to move between an open (e.g., vertical) configuration and a closed (e.g., folded configuration) in order to reduce the footprint of the mechanism when the support beam is lowered. The mining roof support system also includes a pivot mechanism that is intended to allow a vertical rotation of the support beam. The pivot mechanism is also intended to limit the vertical rotation of the support beam to prevent damage to the support beam or any related components of the support system.

It will be apparent to those skilled in the art that various modifications and variations can be made to the disclosed mining roof support system. Other embodiments will be apparent to those skilled in the art from consideration of the specification and practice of the disclosed mining roof support system. It is intended that the specification and examples be considered as exemplary only, with a true scope being indicated by the following claims and their equivalents.

What is claimed is:

1. A support system for a mining roof, the support system comprising:

a base;

a cylinder coupled to the base and configured to extend and retract;

a pivot mechanism coupled to the cylinder;

a roof support beam coupled to the pivot mechanism and configured to contact a surface of the mining roof, wherein the roof support beam and the pivot mechanism are raised relative to the base when the cylinder is extended and lowered relative to the base when the cylinder is retracted; and a support structure coupled to the base on a first end and coupled to the pivot mechanism on a second end, the support structure being configured to limit movement of the roof support beam about an axis provided by the cylinder; and wherein the support structure includes two or more pivotable sections and the support structure is configured to move between a closed configuration when the cylinder is retracted and an open configuration when the cylinder is extended; and wherein each of the two or more pivotable sections are stacked substantially vertically on a single axis when the support structure is in the open configuration and the cylinder is fully extended.

2. The support system of claim 1, wherein the roof support beam is configured to pivot relative to the cylinder to provide a vertical rotation of the roof support beam relative to the base.

3. The support system of claim 2, wherein the pivot mechanism is configured to limit the vertical rotation of the roof support beam.

4. The support system of claim 3, wherein the support structure is configured to limit a horizontal rotation of the roof support beam relative to the base.

5. The support system of claim 1, wherein the support structure includes a retractable section coupled to the two or more pivotable sections and a base section coupled to the base, wherein the retractable section is configured to fit at least partially within the base section when the cylinder is fully retracted.

6. The support system of claim 1, further comprising:

a lift column coupled to the base and the cylinder, wherein the cylinder is configured to fit partially within the lift column when retracted; and a boom coupled to the lift column and positioned substantially perpendicular to the lift column;

wherein a portion of the support structure is positioned within an opening of the boom.

7. A roof bolter for underground mining, comprising:

a body;

a chassis coupled to the body;

a support system coupled to the chassis and configured to support a mining roof, the support system comprising:

a support base;

a cylinder coupled to the support base and configured to extend and retract;

a pivot mechanism coupled to the cylinder;

a roof support beam coupled to the pivot mechanism and configured to contact a surface of the mining roof, wherein the roof support beam and the pivot mechanism are raised relative to the support base when the cylinder is extended and lowered relative to the support base when the cylinder is retracted; and a support structure coupled to the support base on a first end and coupled to the pivot mechanism on a second end, the support structure being configured to limit movement of the roof support beam about an axis provided by the cylinder; and wherein the support structure includes two or more pivotable sections and the support structure is configured to move between a closed configuration when the cylinder is retracted and an open configuration when the cylinder is extended; and wherein each of the two or more pivotable sections are stacked substantially vertically on a single axis when the support structure is in the open configuration and the cylinder is fully extended.

8. The roof bolter of claim 7, wherein the roof support beam is configured to pivot relative to the cylinder to provide a vertical rotation of the roof support beam relative to the support base.

9. The roof bolter of claim 8, wherein the pivot mechanism is configured to limit the vertical rotation of the roof support beam.

10. The roof bolter of claim 9, wherein the support structure is configured to limit a horizontal rotation of the roof support beam relative to the support base.

11. The roof bolter of claim 7, wherein the support structure includes a retractable section coupled to the two or more pivotable sections and a base section coupled to the support base, and wherein the retractable section is configured to fit at least partially within the base section when the cylinder is fully retracted.

12. The roof bolter of claim 7, further comprising:

a lift column coupled to the support base and the cylinder, wherein the cylinder is configured to fit partially within the lift column when retracted; and a boom coupled to the lift column and positioned substantially perpendicular to the lift column;

wherein a portion of the support structure is positioned within an opening of the boom.

13. A support system for a mining roof, the support system comprising:

a base plate;

a hydraulic cylinder coupled to the base plate and configured to extend and retract relative to the base plate;

a pivot mechanism coupled to the hydraulic cylinder;

a roof support beam coupled to the pivot mechanism and configured to contact a surface of the mining roof, wherein the roof support beam is configured to pivot relative to the pivot mechanism to provide a vertical rotation of the roof support beam relative to the pivot mechanism, and wherein the roof support beam and the pivot mechanism are raised relative to the base plate when the hydraulic cylinder is extended and lowered relative to the base plate when the hydraulic cylinder is retracted; and a support structure coupled to the base plate on a first end and coupled to the pivot mechanism on a second end, the support structure being configured to limit a horizontal rotation of the roof support beam relative to the base plate; and wherein the support structure includes two or more pivotable sections and the support structure is configured to move between a closed configuration when the hydraulic cylinder is retracted and an open configuration when the hydraulic cylinder is extended; and wherein the support structure includes a retractable section coupled to the two or more pivotable sections and a base section coupled to the base plate, and wherein the retractable section is configured to fit at least partially within the base section when the hydraulic cylinder is fully retracted.

14. The support system of claim 13, further comprising:

a lift column coupled to the base plate and the hydraulic cylinder, wherein the hydraulic cylinder is configured to fit partially within the lift column when retracted; and a boom coupled to the lift column and positioned substantially perpendicular to the lift column;

wherein a portion of the support structure is positioned within an opening of the boom.

* * * * *